US007996995B2

(12) United States Patent
Sato et al.

(10) Patent No.: US 7,996,995 B2
(45) Date of Patent: Aug. 16, 2011

(54) ELECTRIC SHAVER

(75) Inventors: Masaaki Sato, Hikone (JP); Shunsuke Komori, Hikone (JP); Takeshi Shiba, Hikone (JP); Jyuzaemon Iwasaki, Nagahama (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 306 days.

(21) Appl. No.: 11/826,232

(22) Filed: Jul. 13, 2007

(65) Prior Publication Data

US 2008/0016694 A1 Jan. 24, 2008

(30) Foreign Application Priority Data

Jul. 21, 2006 (JP) ..... 2006-199952

(51) Int. Cl.
*B26B 19/12* (2006.01)
*B26B 19/04* (2006.01)

(52) U.S. Cl. ..... 30/43.7; 30/43.91; 30/43.92; 30/346.51

(58) Field of Classification Search ..... 30/43.91, 30/43.92, 346.51, 43.8, 43.9, 51, 52, 54, 30/55, 64

See application file for complete search history.

(56) References Cited

U.S. PATENT DOCUMENTS

| | | | | |
|---|---|---|---|---|
| 3,858,461 | A * | 1/1975 | Tolmie | 76/104.1 |
| 5,214,833 | A * | 6/1993 | Yada | 29/418 |
| 5,909,929 | A | 6/1999 | Chen | |
| 5,943,777 | A * | 8/1999 | Hosokawa et al. | 30/34.2 |
| 6,684,509 | B1 * | 2/2004 | Best et al. | 30/43.92 |
| 7,127,818 | B2 * | 10/2006 | Sato et al. | 30/43.7 |
| 7,464,471 | B2 * | 12/2008 | Fukutani et al. | 30/43.91 |
| 2006/0021228 | A1 * | 2/2006 | Shiba et al. | 30/43.92 |
| 2007/0245565 | A1 * | 10/2007 | Sato et al. | 30/43.92 |
| 2007/0261249 | A1 * | 11/2007 | Yamasaki et al. | 30/43.7 |

FOREIGN PATENT DOCUMENTS

| | | | |
|---|---|---|---|
| DE | 10 2005 009 264 | | 8/2006 |
| EP | 1 555 093 | | 7/2005 |
| EP | 1 614 510 | | 1/2006 |
| JP | 02077287 | A * | 3/1990 |
| JP | 02077289 | A * | 3/1990 |
| JP | 4-122282 | | 4/1992 |
| JP | 4-80476 | | 7/1992 |
| JP | 06063253 | A * | 3/1994 |
| JP | 06071061 | A * | 3/1994 |
| JP | 06182062 | A * | 7/1994 |
| JP | 06190157 | A * | 7/1994 |
| JP | 11-128563 | | 5/1999 |

(Continued)

*Primary Examiner* — Jason Daniel Prone
*Assistant Examiner* — Jennifer Swinney
(74) *Attorney, Agent, or Firm* — Bacon & Thomas, PLLC

(57) ABSTRACT

An electric shaver includes net-shaped outer blades; and inner blades sliding reciprocally over an inner side of the outer blades as detachably connected with driving units driven by a motor. Each of the inner blades includes a blade plate having an inversed-like-U shape seen from a longitudinal direction in parallel with a reciprocating sliding direction; and a blade holder having attaching portions to be attached to the blade plate in longitudinally defined end regions, wherein connection portions to be detachably connected with the driving units are provided at the blade holder in a longitudinally defined center region, and, when dissembling the blade holder from the driving units, anti-detach portions are provided to thereby prevent separation of the blade holder in the longitudinally defined center region from the blade plate in the longitudinally defined center region due to a tensile load between the connection portions and the driving units.

8 Claims, 16 Drawing Sheets

FOREIGN PATENT DOCUMENTS

| | | | | |
|---|---|---|---|---|
| JP | 2004-016520 | | | 1/2004 |
| JP | 2004016520 | A | * | 1/2004 |
| JP | 2005-168517 | | | 6/2005 |
| JP | 2005349128 | A | * | 12/2005 |
| JP | 2006314835 | A | * | 11/2006 |
| WO | WO 2004076135 | A1 | * | 9/2004 |

* cited by examiner

ELECTRIC SHAVER

FIELD OF THE INVENTION

The present invention relates to an electric shaver having an inner blade member sliding reciprocally over an inner side of an outer blade; and, more particularly, to an inner blade member which is configured to prevent deformation of a blade holder of an inner blade in a longitudinally defined central region, the deformation being caused when assembling/dissembling the inner blade member to/from a driving unit to be driven by a motor.

BACKGROUND OF THE INVENTION

In general, a reciprocating type electric shaver includes a main body; an outer blade cassette connected with an upper portion of the main body; a net-shaped outer blade disposed at an upper portion of the outer blade cassette; and an inner blade member sliding reciprocally over an inner side of the outer blade, the inner blade being driven while being connected with the main body. Hair (beard) introduced through apertures of the outer blade is cut by reciprocal motion of blades of the inner blade member over the apertures of the outer blade (see, e.g., Japanese Patent Laid-open Application No. 2004-16520).

A conventional inner blade member 4' is formed with a blade plate 10 and a blade holder 11. Pair of holding members 21, which are provided at the blade holder 11 in longitudinally defined end regions D2, are fixed as a unit with the blade plate 10 in longitudinally defined end regions D2. Provided at the blade holder 11 in a longitudinally defined center region D1 are connection portions 5 to which driving units 7 protruded from the main body 1 are detachably attached.

Typically, conventional connection portions 5 are configured to be tightly inserted to the driving units 7, providing no easy separation therefrom. Accordingly, when dissembling the inner blade member 4' for cleaning, finger holders 22 provided at the blade holder 11 in the longitudinally defined end regions D2 are held by fingers and need to be pulled strongly toward a direction A away and from the driving units 7. Since the blade holder 11 in the longitudinally defined center region D1 is loose from the blade plate 11 and is provided with the connection portions 5 that are not easily separable from the driving units 7, a tensile load B between the connection portions 5 and the driving units 7 (engaging force between the connection portions 5 and the driving units 7) causes the blade holder 11 in the longitudinally defined center region D1 to deform in a direction away from the blade plate 10 and also puts stress on the connection portions 5. When repetitively assembling and dissembling the connection portions 5, the connection of the connection portions 5 and the driving units 7 becomes loose and unstable, thereby failing to prevent the connection portions 5 from being easily detached off from the driving units 7. In particular, when a load on a motor of the driving units 7 is reduced by decreasing the weight of the inner blade member 4 or when a height of the blade plate 10 is scaled down to reduce the size of blades, the blade holder 11, which may be made of plastic, is suffered from being not rigid enough to overcome repetitive assembling/dissembling. Accordingly, the blade holder 11 in the longitudinally defined center region D1 becomes vertically too bendable when assembling/dissembling the connection portions 5 to/from the driving units 7. As a result, attachability and detachability become unreliable, thereby making it difficult to assemble/dissemble the connection portions 5 to/from the driving units 7.

SUMMARY OF THE INVENTION

It is, therefore, an object of the present invention to provide an electric shaver capable of preventing deformation, when dissembling an inner blade member from a driving unit, of a blade holder in a longitudinally defined center region in a tensile direction. This allows for a long period of time an easy detachability between the connection portions 5 and the driving units 7, and smooth assembling/dissembling of the inner blade members to/from the driving units. Further, it is another object of the present invention to provide an electric shaver capable of preventing deformation of the blade holder in the longitudinally defined center region in a compressive direction when assembling the inner blade to the driving unit, to thereby prevent stress by the deformation from being generated in a connection portion.

In accordance with the present invention, there is provided an electric shaver including net-shaped outer blades; and inner blades sliding reciprocally over an inner side of the outer blades as detachably connected with driving units driven by a motor, wherein each of the inner blades includes: a blade plate having an inversed U shape seen from a longitudinal direction in parallel with a reciprocating sliding direction; and a blade holder having attaching portions to be attached to the blade plate in longitudinally defined end regions, wherein connection portions to be detachably connected with the driving units are provided at the blade holder in a longitudinally defined center region, and, when dissembling the blade holder from the driving units, anti-detach portions are provided near the connection portions to thereby prevent separation of the blade holder in the longitudinally defined center region from the blade plate in the longitudinally defined center region due to a tensile load between the connection portions and the driving units.

In the above configuration, when dissembling the inner blade member 4 from the driving units 7, the blade holder 11 in the longitudinally defined end regions D2 is held by fingers and need to be pulled strongly in a direction away from the driving units 7. At this time, the tensile load B from the driving units 7 (engaging force between the connection portions 5 and the driving units 7) is applied to the longitudinally defined center region D1 of the blade holder 11 where the connection portions 5 are provided. In order to prevent the blade holder 11 in the longitudinally defined center region D1 from being detached from the longitudinally defined center region D1 of the blade plate 10, the anti-detach portions 6 are provided near the connection portions 5 of the blade holder 11 in accordance with an embodiment of the present invention.

Accordingly, the stress by the deformation is not generated of the connection portions 5 of the blade holder and, hence, a loose contact between the connection portions 5 and the driving units 7 does not occur even if the connection portions 5 are repetitively used to assemble and dissemble. As a consequence, it is possible to stably connect the connection portions 5 to the driving units 7 for a long period of time. Further, when a load on a motor of the driving units 7 is reduced by decreasing a weight of the inner blade member 4 or when a height of a blade is reduced to reduce the size of blades, even if the blade holder 11, which may be made of plastic, suffers from not being rigid enough, the anti-detach portions 6 prevent the deformation of the blade holder 11 in the longitudinally defined center region D1 during assembling and dissembling. As a result, attachability and detachability for assembling and dissembling the inner blade member 4 to/from the driving units 7 become reliable.

It is preferable that the anti-detach portions may prevent, when attaching the blade holder to the driving unit, deformation of the blade plate in the longitudinally defined center region deforming closer to the blade holder in the longitudinally defined center region due to a compressive load applied to the blade plate in the longitudinally defined center region. In this case, the anti-detach portions 6 have a first anti-detach function with respect to the tensile load B and a second anti-detach function with respect to the compressive load C. Due to the interaction between the effects of preventing the deformation in the tensile stress and those of preventing the deformation in the compressive direction by the anti-detach portions 6, the stress due to the deformation can be prevented from being generated in the connection portions 5.

It is preferable that the blade holder may be provided with plate members for supporting upper rear surfaces of the blades close to the blade plate in the longitudinally defined center region against the compressive load applied, when attaching the blade holder to the driving units, to the blade plate in the longitudinally defined center region. In this case, the plate members 19 prevent deformation of the blade plate 10 in the compressive direction in the longitudinally defined center region D1. Due to the interaction with the effects of preventing the deformation in the tensile direction with the anti-detach portions 6, the stress by the deformation can be prevented from occurring in the connection portions 5.

It is preferable that the plate members may have at leading ends thereof insertion-fitting portions to be insertion-fitted without being detached from the upper rear surfaces of the blades. In this case, the leading ends of the plate members 19 can be insertion-fitted without being detached from the upper rear surfaces 8*a* of the blades 8. Therefore, even when the inner blade member 4 vibrates, the plate members 19 are neither tilted nor separated from the blades 8, thereby further enhancing the effects of preventing the deformation of the blade holder 11 by the plate members 19.

It is preferable that the anti-detach portions may be formed as hooks to be engaged at gaps between the blades. In this case, the blade holder 11 in the longitudinally defined center region D1 can be prevented from being detached from the blade plate 10 in the longitudinally defined center region D1 simply by engaging the anti-detach portions 6 with the cutouts 12 between the blades 8. Accordingly, no additional holes is needed for engaging the anti-detach portions 6 with the blade plate 10, which makes it possible to avoid the blade plate 10 from deteriorating in rigidity due to boring.

It is preferable that the anti-detach portions and the plate members may be misaligned in the longitudinal direction of the blade holder. In this case, the engaging position of the anti-detach portions 6 with respect to the blade plate 10 and an insertion-fitting position of the plate members 19 with respect to the blade plate 10 are misaligned in the longitudinal direction D. In other word, the anti-detach portions 6 and the plate members 19 are arranged in a truss structure having high bending strength and compressive strength, thereby further enhancing the structural rigidity of the blade holder 11 in the longitudinally defined center region D1 with respect to the blade plate 10.

The inner blades of the electric shaver in accordance with an embodiment of the present invention have the anti-detach portions near the connection portions provided at the blade holder 11 in the longitudinally defined center region D1, to thereby prevent detaching of the blade holder 11 in the longitudinally defined center region D1 from the blade plate 10 in the longitudinally defined center region D1. Therefore, even if the tensile load from the driving unit (engaging force between the connection portion and the driving unit) is applied to the blade holder 11 in the longitudinally defined center region D1 when detaching the inner blade member from the driving unit, the anti-detach portions prevent the deformation of the blade holder 11 in the longitudinally defined center region D1. Accordingly, it is possible to maintain for a long period of time the function of preventing an easy detachment therebetween and stabilize the force of assembling/dissembling the inner blade to/from the driving unit. Therefore, the smooth attachment/detachment operations can be obtained.

Due to the function of preventing deformation of the blade holder 11 in the longitudinally defined center region D1 due to the compressive load when assembling the blade holder 11 to the driving unit, the effects of preventing the deformation in the tensile stress are related to those of preventing the deformation in the compressive direction. As a result, the stress by the deformation can be prevented from occurring in the connection portions.

BRIEF DESCRIPTION OF THE DRAWINGS

The above and other objects and features of the present invention will become apparent from the following description of embodiments, given in conjunction with the accompanying drawings, in which.

DETAILED DESCRIPTION OF THE EMBODIMENTS

Hereinafter, embodiments of the present invention will be described in detail with reference to the accompanying drawings.

Figure 2:
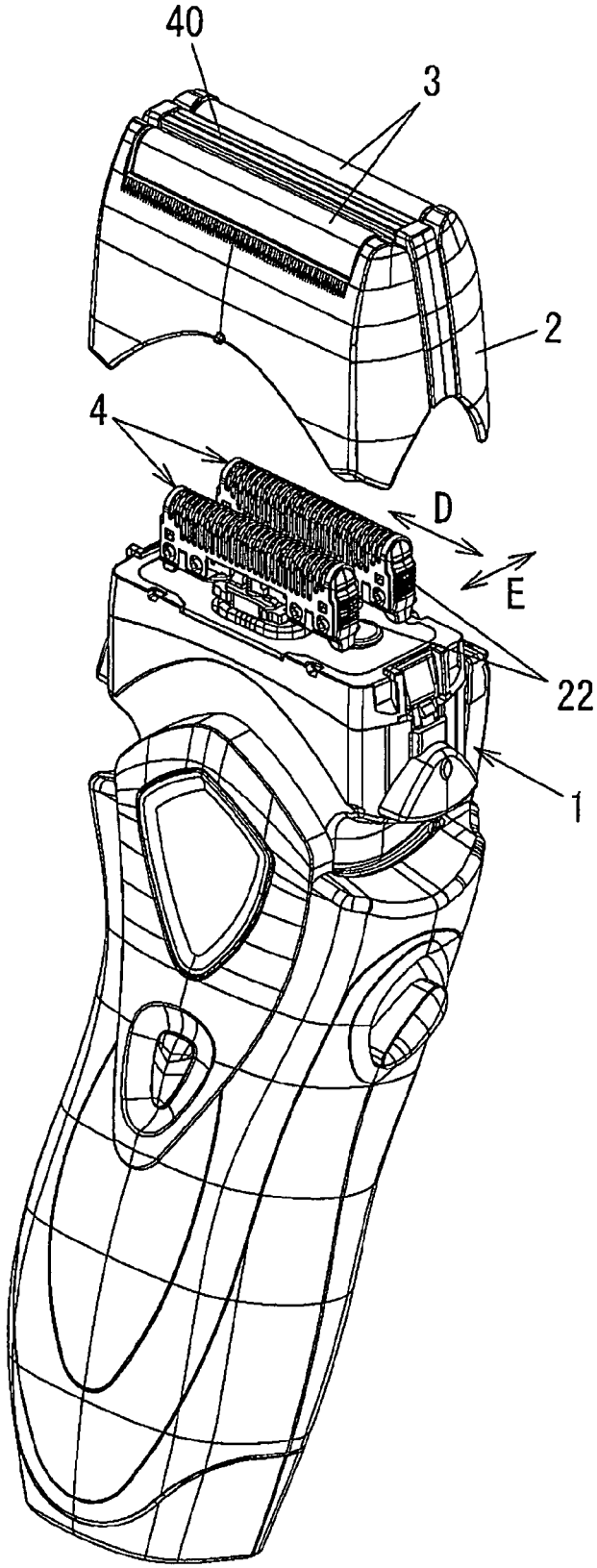
FIG. 2 illustrates a perspective view of an electric shaver employing the inner blade member.

FIG. 2 shows a reciprocating type electric shaver in accordance with an embodiment of the present invention. The electric shaver of this embodiment includes a main body 1 accommodating therein a motor (not shown); an outer blade cassette 2 to be connected with an upper rim of the main body 1; a pair of net-shaped outer blades 3 and a center blade 40, all being provided at a top opening of the outer blade cassette 2; and a pair of inner blade member 4 disposed at inner sides of the outer blades 3 and detachably connected at the main body 1.

Figure 3:
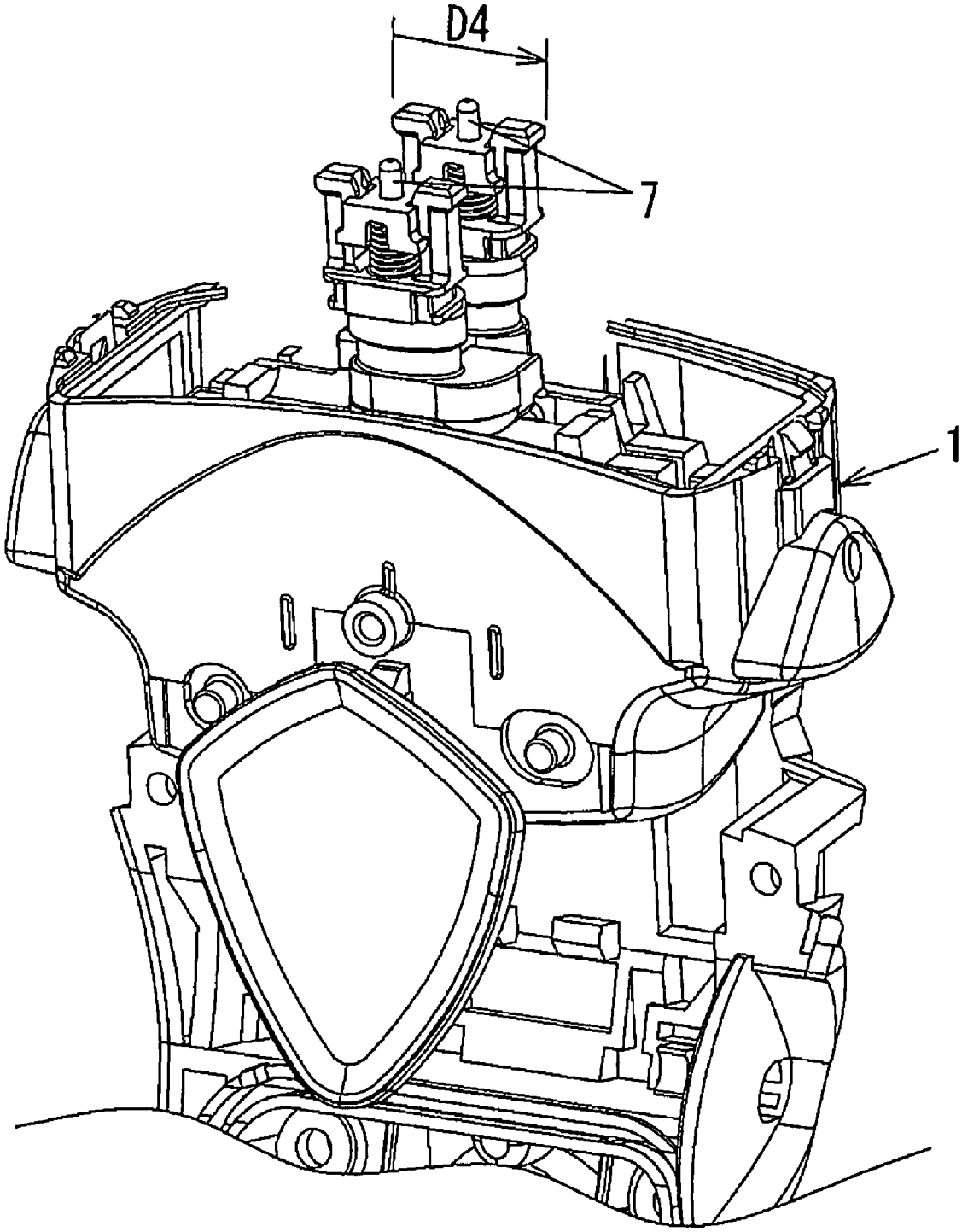
FIG. 3 illustrates an enlarged perspective view of driving units used for connecting the inner blade members.

As illustrated in FIG. 3, a pair of driving units 7 are disposed protruding from an upper portion of the main body 1. When the pair of inner blade member 4 (see FIG. 2) detachably attached to the driving units 7 move reciprocally as a unit with the driving units 7, hair (beard) introduced through apertures of the outer blades 3 is cut by reciprocal motion of the apertures of the outer blades 3 over a plurality of blades of the inner blade member 4.

Figure 1:
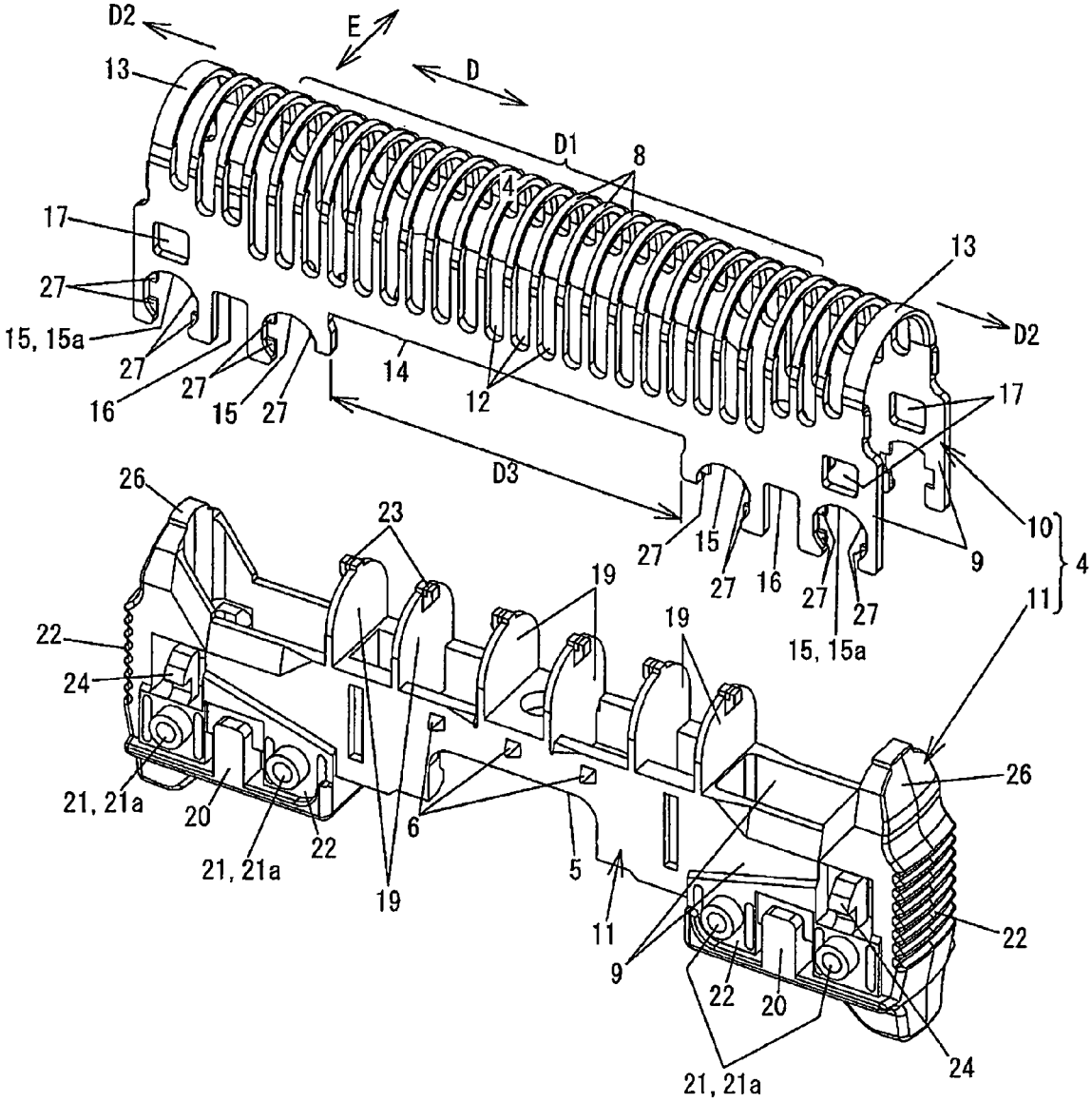
FIG. 1 illustrates an exploded view of an inner blade member in accordance with an embodiment of the present invention.

The following is a detailed description on a structure of an inner blade member 4 in accordance with the present invention. As illustrated in FIG. 1, the inner blade member 4 is formed by fixing a blade holder 11 of the inner blade member 4 to an inner side of a blade plate 10. The blade plate 10 is jointly formed with lower ends of blades 8, each having an inverse-U-like shape when seen from a reciprocating sliding direction. The blade holder 11 serves as a connector transferring the reciprocal motion of the driving units 7 disposed at the main body 1. Hereinafter, the reciprocating direction is referred to as "longitudinal direction D", whereas a direction perpendicular to the reciprocating direction is referred to as "perpendicular direction E".

The blade holder 11 is formed as a member having a length that is suffice to be fit in the blade plate 10. Provided at the blade holder 11 in the longitudinally defined end regions D2 are finger holders 22 serving as grips for fingers when assembling/dissembling the inner blade member 4 to/from the main body 1.

Meanwhile, the blade plate 10 is formed of a steel plate press-bent in an arch shape, so that its upper portion has an upwardly protruded circular arc-shaped cross section. A plurality of blades is installed in parallel at the upper portion of the blade plate 10, thereby forming slit-shaped cutouts 12 therebetween. In the example shown in FIG. 1, lower portions of the cutouts 12 between the blades 8 in the longitudinally defined end regions D2 are positioned higher than those of the cutouts 12 between the blades 8 in the longitudinally defined center region D1. Accordingly, anti-detach hooks 6 to be described later can be engaged with any lower portions of the cutouts 12.

Figure 6:
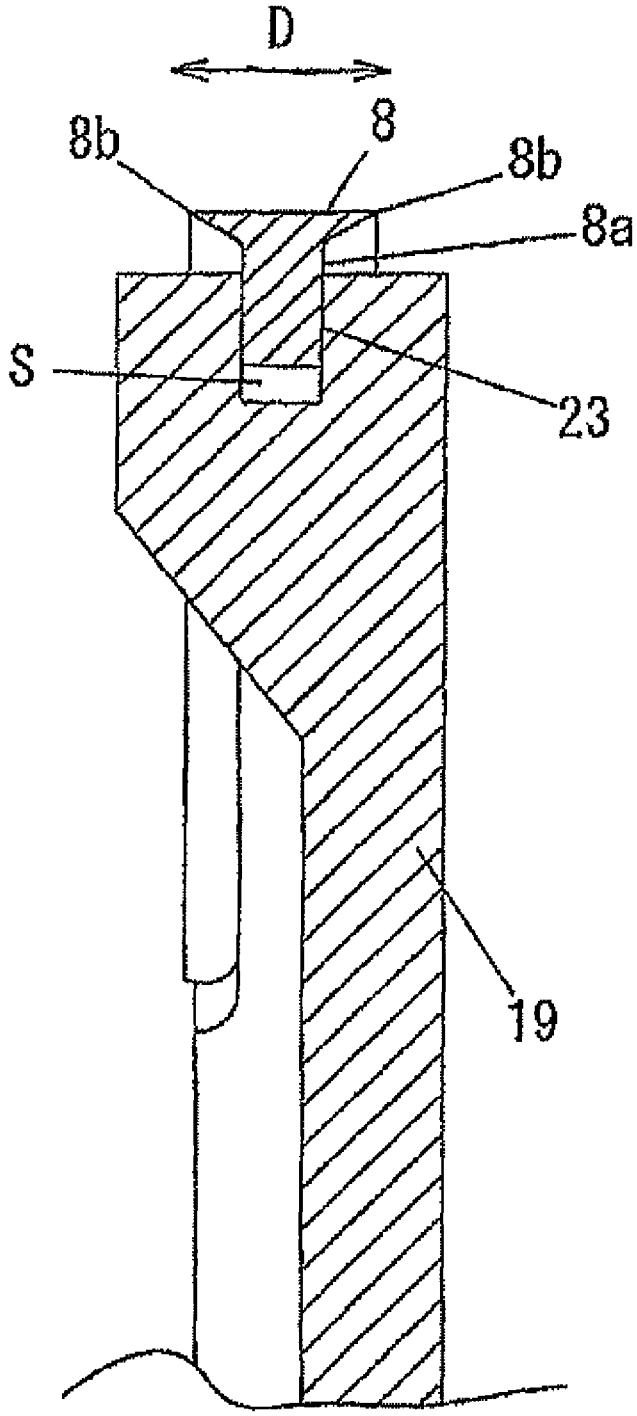
FIG. 6 illustrates a cross sectional front view to explain an example of an insertion-fitting between a plate member and blades.

As can be seen from FIG. 6, the blades 8 have on both sides of its upper portion, sharp edges 8*b* tapered in the longitudinal direction D, whereas portions other than the sharp edges 8*b* are relatively thin.

Moreover, as shown in FIG. 1, guard edges 13 having a width greater than that of the blades 8 are provided at the blade plate 10 in the longitudinally defined end regions D2. The guard pieces 13 as well as the blades 8 have an inverse-U-like shape. By having the guard pieces 13 at the longitudinally defined end regions D2, the entire blade plate 10 can be structurally remained and the blades 8 can be protected from outer impact. Further, the guard pieces 13 are provided to be contacted with protrusions 26 which extend upward from two top ends of the finger holders 22, to thereby serve the function of a vertical positioning guide. Also, the protrusions 26 prevent noise that is generated by the blades 8 being vibrated during shaving from being lost to the outside, thereby providing a comfortable shaving sound for a user.

Further, as shown in FIG. 1, cut-portions 14 opened at the bottom are formed at two bottom sides in the central portion of the blade plate 10 in the longitudinal direction D, and substantially square angled recesses 16 opened at the bottom are formed at both sides of the cut-portions 14 in the longitudinal direction D. By performing insertion-fitting on square protrusions 20 provided at the blade holder 11 onto the square recesses 16, the blade plate 10 is positioned with respect to the blade holder 11 in the longitudinal direction D. Further, when uneven surfaces 22 formed on a front and a rear surface of the blade holder 11 are made to directly contact with both lower portions of the blade plate 10, the blade plate 10 is positioned with respect to the blade holder 11 in the perpendicular direction E.

As can be seen from FIG. 1, the blade plate 10 and the blade holder 11 are assembled by fixing, as a unit, holding members 21 provided at the blade holder 11 in the longitudinally defined end regions D2 to the blade plate 10 in the longitudinally defined end regions D2. In this example, substantially circular recesses 15 opened at the bottom are formed at two sides of the angled recesses 16, and thin protrusions 27 are protruded inward from four locations on an inner peripheral surface of each of the angled recesses 15. In order to fix the blade holder 11 to the blade plate 10, the blade holder 11 is inserted from the bottom into the blade plate 10 and, then, heat seal bosses 21*a* provided as pairs at both corners of the front and the rear surface of the blade holder 11 are heat-sealed while being positioned to be inserted into the circular recesses 15 by the thin protrusions 27.

Furthermore, angled window portions 17 are disposed above circular openings 15*a* positioned at outer sides among the pairs of circular recesses 15, as illustrated in FIG. 1. When the angled window portions 17 are engaged with engaging hooks 24 formed at the longitudinally defined end regions D2 of the blade holder 11, the longitudinally defined end regions D2 of the blade plate 10 are prevented from being detached from the longitudinally defined end regions D2 of the blade holder 11.

Hereinafter, the anti-detach portions 6 characterized by the present invention will be explained.

The connection portions 5 detachably connected with the driving units 7 (see FIG. 3) protruded from the main body are provided at the longitudinally defined center region D1 of the blade holder 11, and the anti-detach portions 6 are provided at a vicinity of the connection portions 5.

Herein, the "vicinity of the connection portions 5" preferably indicates the region (e.g., a section in D1 shown in FIG. 1) that is within a boundary set between the right and the left holding members 21 provided at the blade plate 10 in the longitudinal direction D. In order to secure the force applied from the anti-detach portions 6 to the blade holder 11, it is preferable to position the anti-detach portions 6 within a width of the cut-portions 14 provided at the blade holder 11 in the longitudinal direction D (e.g., a section in D3 shown in FIG. 1) and more preferably within a width of the driving units 7 in the longitudinal direction D (e.g., a section in D4 shown in FIG. 3).

Figure 4A:
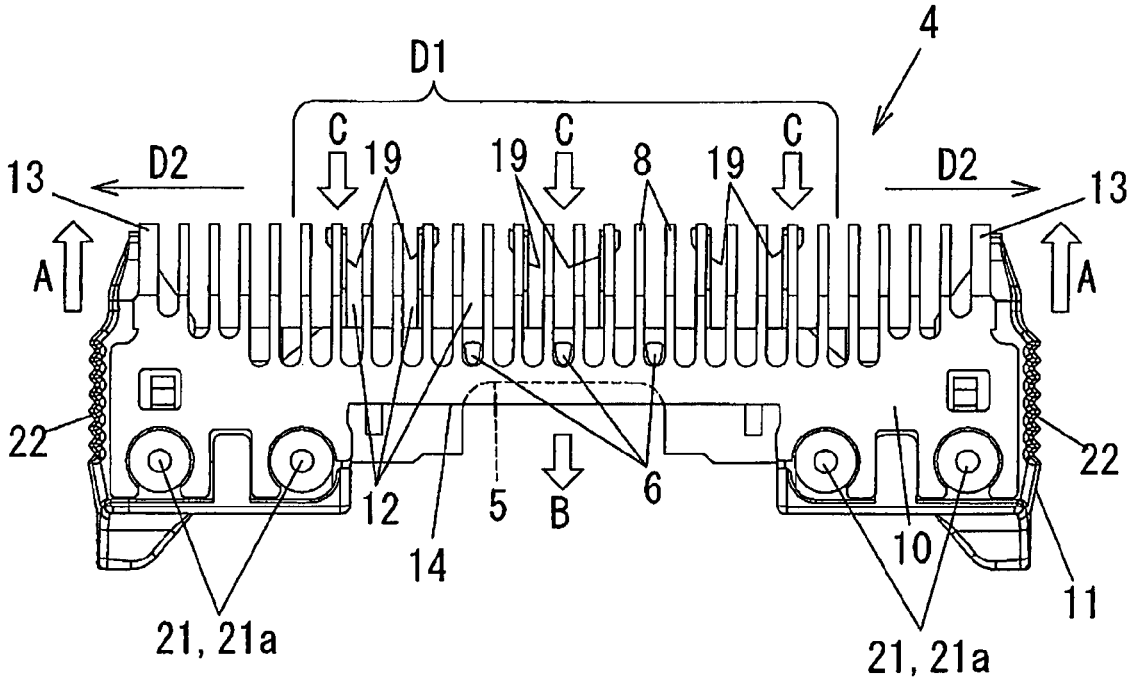
FIGS. 4A and 4B illustrate a front and a bottom view of the inner blade member, respectively.
Figure 4B:
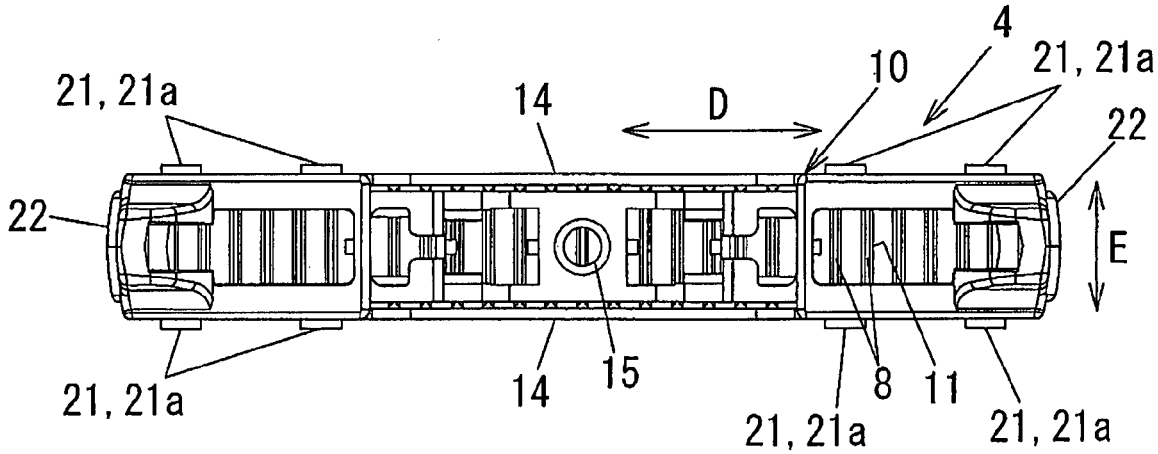
Figure 9:
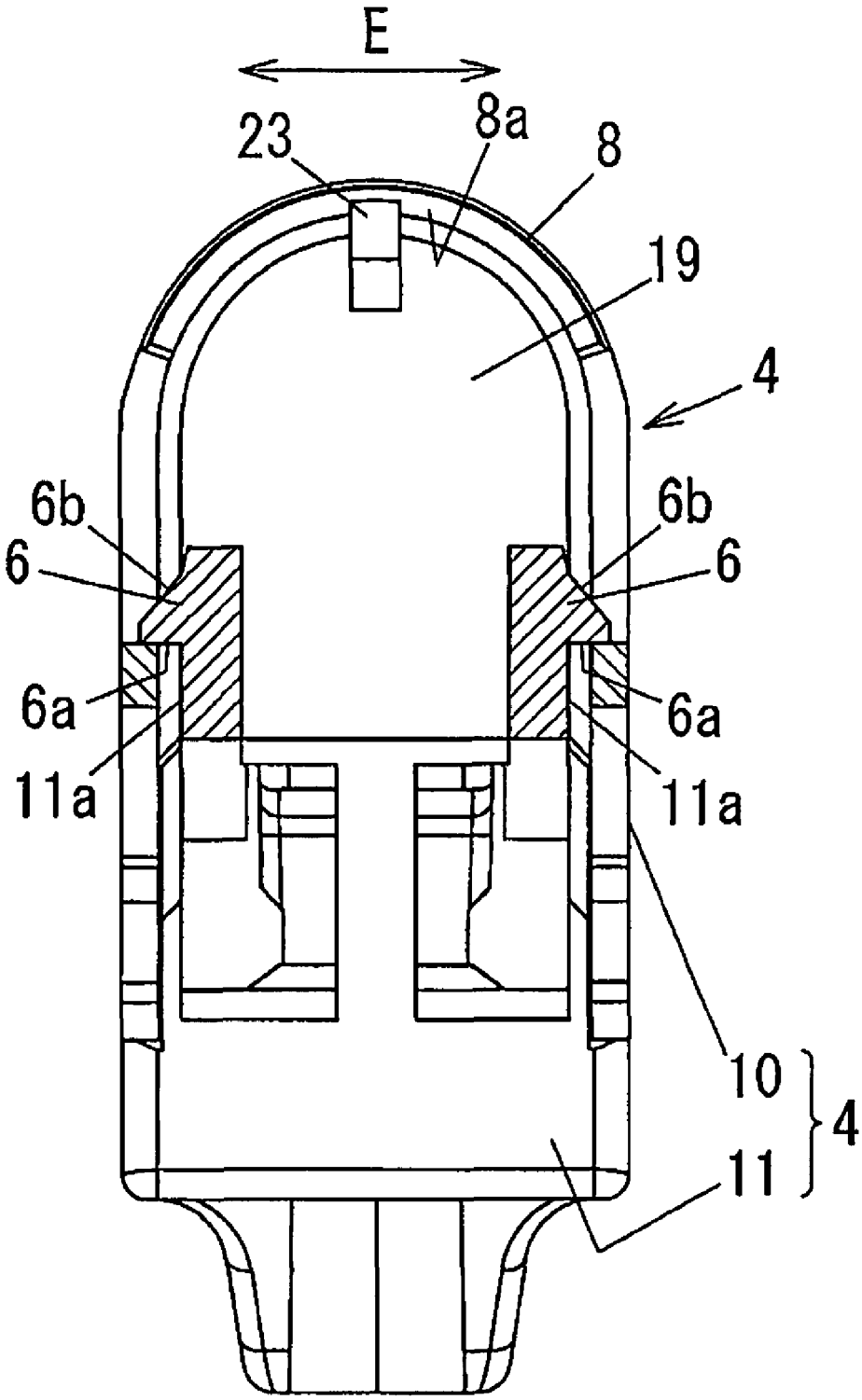
FIG. 9 illustrates a cross sectional side view to explain an engagement between a anti-detach portion and a blade plate.
Figure 10:
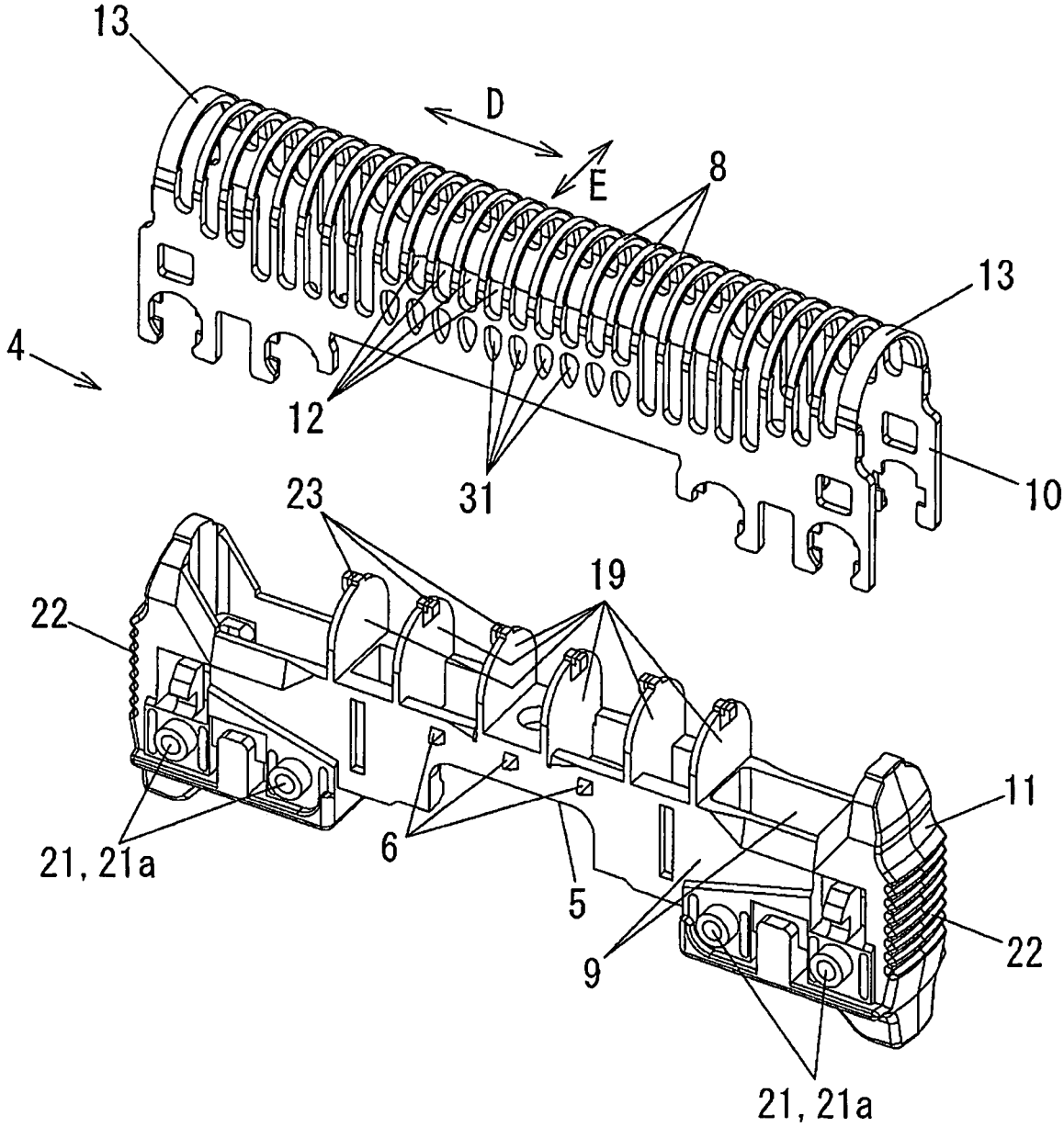
FIG. 10 illustrates an exploded perspective view of an inner blade member used in accordance with another embodiment of the present invention.

As illustrated in FIGS. 1, 4 and 9, the anti-detach portions 6 in this example are formed as hooks protruded in the perpendicular direction E perpendicular to the longitudinal direction D of the blade holder 11 so as to be engaged with the lower portions of the gaps 13 between the blades 8 of the blade plate 10 (hereinafter, referred to as "anti-detach hooks 6"). In this example, the anti-detach hooks 6 are installed to be protruded from two sides of the connection portions 5 in the perpendicular direction E. As can be seen from FIG. 9, the anti-detach hooks 6 are protruded from both outer wall surfaces 11*a* of the blade holder 11 in the perpendicular direction E.

Further, bottom surfaces of the anti-detach hooks 6 serve as engaging surfaces 6*a* perpendicular to the outer wall surfaces 11*a* of the blade holder 11, and top surfaces of the anti-detach hooks 6 serve as tapered surfaces 6*b* inclining downward toward leading end sides thereof. By introducing the anti-detach hooks 6 into the cutouts 12 between the blades 8, the engaging surfaces 6*a* of the anti-detach hooks 6 are engaged with the lower portions of the cutouts 12 corresponding thereto, thereby engaging the longitudinally defined center region D1 of the blade holder 11 with the blade plate 10 in the longitudinally defined center region D1.

In the example shown in FIGS. 1 and 4, a plurality of, e.g., three, anti-detach hooks 6 spaced from each other at regular intervals in the longitudinal direction D are provided close to the blade holder 11 in the longitudinally defined center region D1 at the same height. Due to the presence of the anti-detach hooks 6, when the blade holder 11 is detached from the driving units 7 (see FIG. 3), the blade holder 11 in the longitudinally defined center region D1 is prevented from being detached from the blade plate 10 in the longitudinally defined center region D1 by the tensile load B between the connection portions 5 and the driving units 7.

Figure 5A:
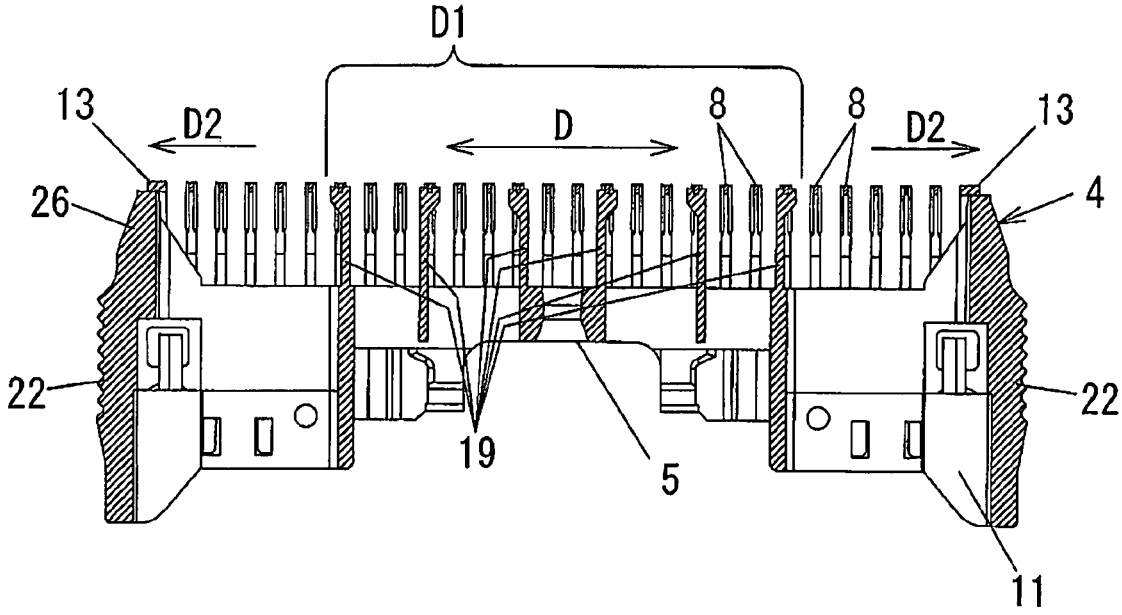
FIGS. 5A and 5B illustrate a cross sectional front view of a blade holder of the inner blade member and an enlarged view of principal parts in the blade holder of FIG. 5A, respectively.
Figure 5B:
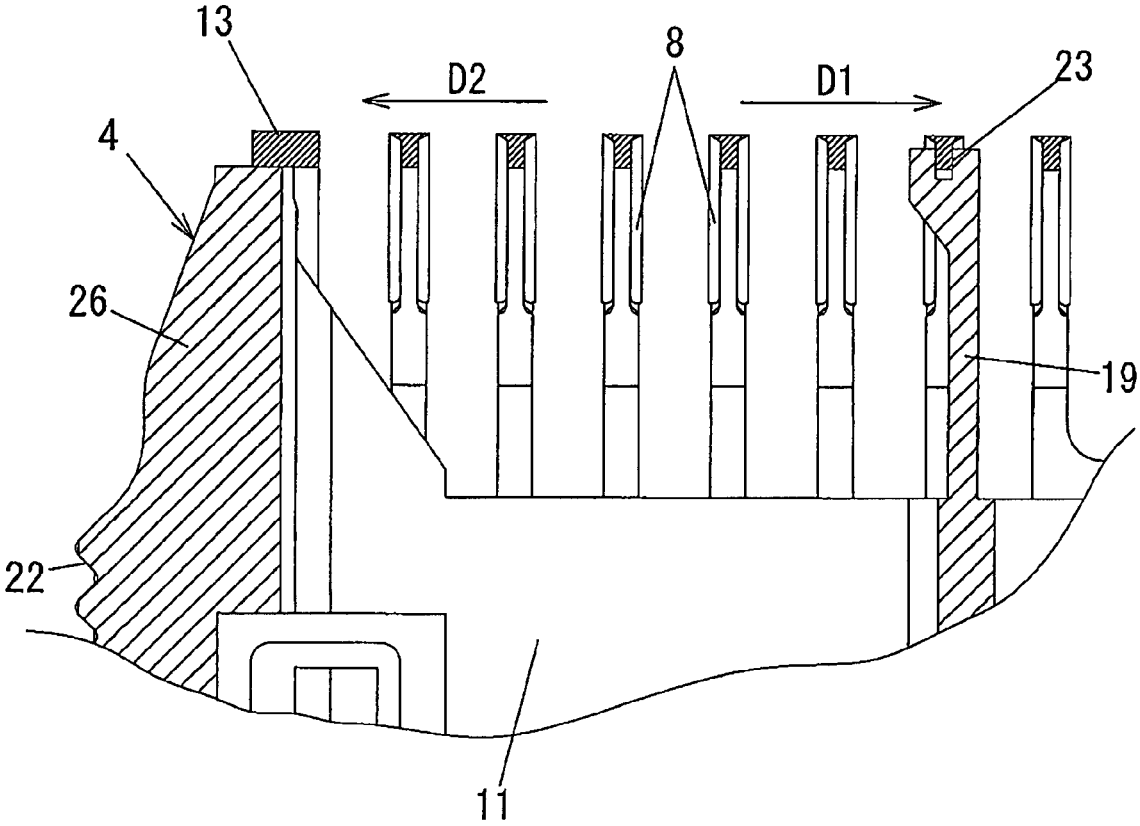

As depicted in FIGS. 1 and 5, plate members 19 spaced from each other in the longitudinal direction D are installed to be protruded from the longitudinally defined center region D1 of the blade holder 11. When the blade holder 11 is attached to the driving units 7 (see FIG. 3), the plate members 19 are configured to prevent deformation of the blade plate 10 in the longitudinally defined center region D1 due to a compressive load C (see FIG. 4) in a direction close to the blade holder 11 in the longitudinally defined center region D1.

The plate members 19 in this example are vertically installed on upper portions of a pair of front and rear walls 9 of the blade holder 11. Moreover, the plate members 19 are formed of thin plates that are arranged on a vertical plane perpendicular to the blade holder 11 in the longitudinal direction D. The plate members 19 are curved at the curvature of the blades 8 along the entire length of the rear surfaces of the blades 8 having an inversed-U-like shape. As shown in FIG. 6, recessed groove shaped insertion-fitting portions 23 formed at central portions of leading ends of the plate members 19 are insertion-fitted to the upper rear surfaces 8*a* of the blades 8 so as not to be detached therefrom.

In the example shown in FIGS. 1 and 4A, a plurality of, e.g., six, plate members 19 spaced from each other at regular intervals in the longitudinal direction D are provided at the blade holder 11 in the longitudinally defined center region D1. The distance between the plate members 19 is defined by a multiple constant equal to the distance between the blades 8 (three times the distance between the blades 8 in this example), and each of the plate members 19 is disposed with one individual blade 8.

In this example, the plate members 19 and the anti-detach hooks 6 are arranged so that three anti-detach hooks 6 are disposed within four of the plate members 19, the four plate members 19 being the four middle ones among the six plate members 19. That is, as can be seen from FIG. 4A, the anti-detach hooks 6 are misaligned in the longitudinal direction D (horizontal direction in FIG. 4A), rather than being directly under the four middle plate members 19. Accordingly, the engaging position of the anti-detach hooks 6 with respect to the blade plate 10 and the insertion-fitting position of the plate members 19 with respect to the blade plate 10 are arranged in a truss-like structure, thereby enhancing the engagement of the blade plate 10 with the blade holder 11. However, the plate members 19 and the anti-detach hooks 6 are not required to be misaligned in the longitudinal direction D, that is, the manner described in the above. Four of the anti-detach hooks 6 may also be disposed directly under four of the plate members 19.

When dissembling the inner blade member 4 configured as described above, as in case of the conventional inner blade member 4, the finger holders 22 provided at the longitudinally defined end regions D2 of the blade holder 11 are held by fingers and need to be pulled strongly in a direction A away from the driving units 7 (see FIG. 4). At this time, the tensile load B from the driving units 7 is applied to the blade holder 11 in the longitudinally defined center region D1, where the connection portions 5 are provided. In order to prevent detaching of the blade holder 11 in the longitudinally defined center region D1 from the blade plate 10 in the longitudinally defined center region D1, the anti-detach hooks 6 may be provided near the connection portions 5 of the blade holder 11 in the present invention.

Accordingly, the deformation of the blade holder 11 in the longitudinally defined center region D1 is suppressed and, thus, the stress due to the deformation is avoided in the connection portions 5. Accordingly, even if the assembling/dissembling operations are performed repetitively, the connection portions 5 can be stably connected to the driving units 7 for a long period of time without being loosen, thereby preventing for a long period of time an easy detachability therebetween. In particular, when a load of a motor is reduced by reducing the weight of the inner blade member 4 or when a height of a blade member is scaled down to reduce the size of blades, even if the blade holder 11, which may be made of plastic, has insufficient stiffness, the anti-detach hooks 6 prevent the deformation of the blade holder 11 in the longitudinally defined center region D1 during the assembling/dissembling operations of the blade plate 10. As a result, attachability/detachability of the inner blade member 4 to/from the driving units 7 becomes reliable, and the smooth attachment/detachment operations can be ensured.

Meanwhile, when assembling the inner blade member 4 to the driving units 7, the finger holders 22 provided at the blade holder 11 in the longitudinally defined end regions D2 are held by fingers and need to be pushed strongly toward the driving units 7 (see FIG. 3), as in case of the prior arts. At this time, the blade plate 10 in the longitudinally defined center region D1 may be pressed by the fingers, applying the tensile load C thereto. However, in the present invention, the upper rear surfaces 8*a* of the blades 8 close to the blade plate 10 in the longitudinally defined center region D1 are supported by the plate members 19.

Therefore, even if the blade plate 10 in the longitudinally defined center region D1 is pressed by the fingers, the plate members 19 prevent deformation of the blade holder 11 due to the compressive load C in the longitudinally defined center region D1. Due to the interaction with the effects of preventing the deformation in the tensile direction by the anti-detach portions 6, the connection state between the connection portions 5 and the driving units 7 becomes more stable, thereby maintaining the function of preventing an easy detachment therebetween for a long period of time and also ensuring the smooth attachment/detachment operations.

Further, as shown in FIG. 4A, the anti-detach hooks 6 and the insertion-fitting portions 23 of the plate members 19 are misalign in the longitudinal direction D, so that the engaging position of the anti-detach portions 6 with respect to the blade plate 10 and the insertion-fitting position of the plate members 19 with respect to the blade plate 10 are shifted in the longitudinal direction D. That is, the anti-detach hooks 6 and the insertion-fitting portions 23 of the plate members 19 are arranged in a truss-like structure, which greatly enhances the structural rigidity of the blade holder 11 with respect to the blade plate 10 in the longitudinally defined center region D1.

In this example, when the blade 10 and the blade holder 11 are assembled, the anti-detach hooks 6 are engaged with the lower portions of the cutouts 12 between the blades 8 to thereby prevent the disengaging between the longitudinally defined center region D1 of the blade plate 10 and the longitudinally defined center region D1 of the blade holder 11. Accordingly, no need for additional holes for engaging the anti-detach portions 6 with the blade plate 10 is needed, which makes it possible to avoid the blade plate 10 from deteriorating in rigidity due to boring. Further, during the assembly, the insertion-fitting portions 23 can be precisely insertion-fitted without being disengaged from the upper rear surfaces 8*a* of the blades 8. This is because the upper peripheral portions of the insertion-fitting portions 23 are positioned higher than the lower portions of the blades 8 by forming the insertion-fitting portions 23 provided at the leading ends of the plate members 19 in the recessed groove shape shown in FIG. 6.

Figure 7:
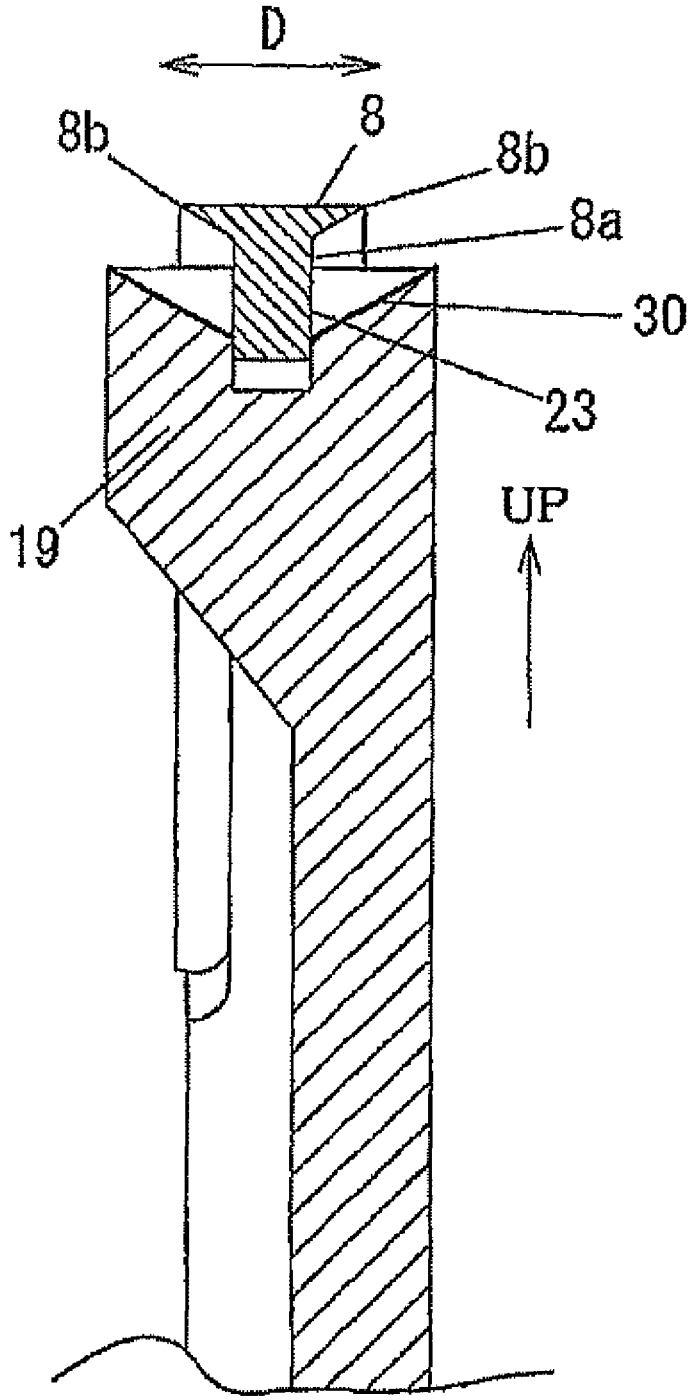
FIG. 7 illustrates a cross sectional front view to explain another example of the insertion-fitting between the plate member and the blades.
Figure 8:
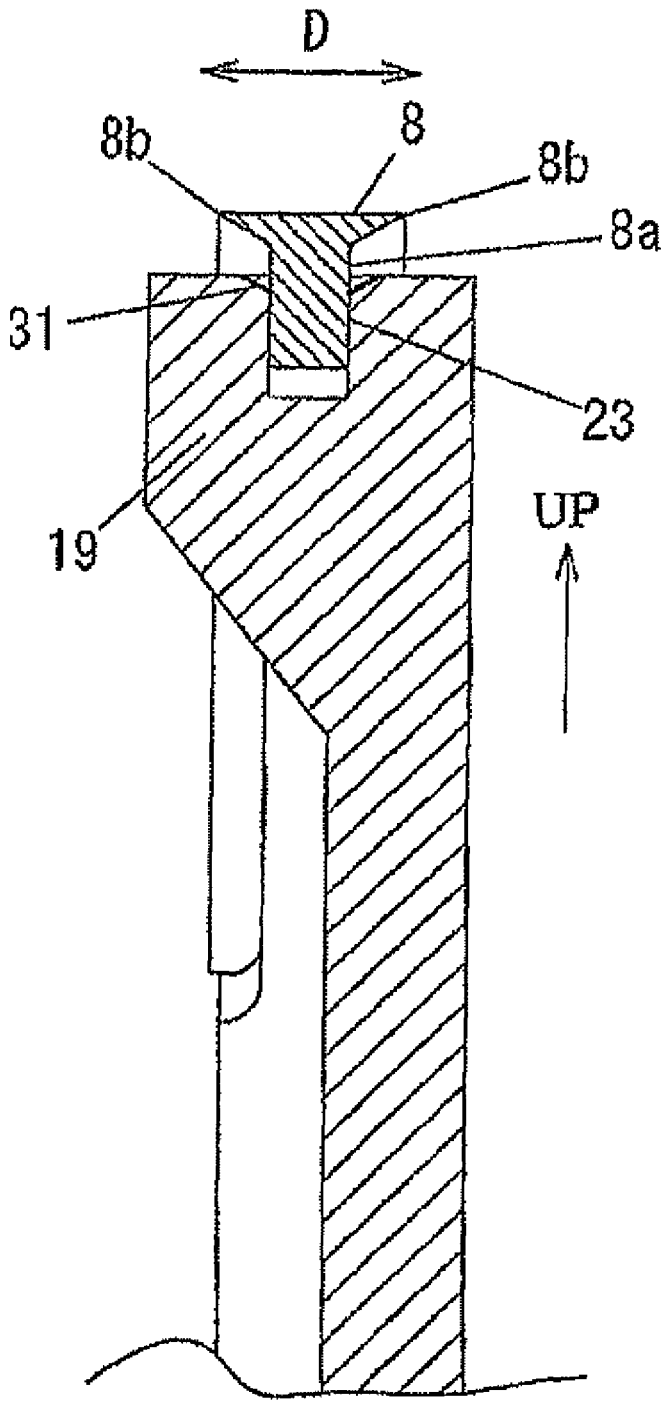
FIG. 8 illustrates a cross sectional front view to explain still another example of the insertion-fitting state between the plate member and the blades.

As a consequence, even with the inner blade member 4 vibrating, the plate members 19 are kept from being tilted nor separated from the blades 8, thus further preventing the deformation of the blade holder 11 by the plate members 19. In the example shown in FIG. 6, the lower portions of the blades 8 are spaced from the bottom surfaces of the insertion-fitting portions 23, thereby forming a space S capable of providing buffering effect for a dimensional error, an assembly error or the like in the plate members 19 and the blades 8. Moreover, as shown in FIG. 7 or 8, tapered surfaces 30 (31) sloping downward toward the insertion-fitting portions 23 are formed on the upper peripheral surfaces of the insertion-fitting portions 23. Accordingly, the lower portions of the blades 8 can be smoothly engaged into the insertion-fitting portions 23, which results in even more improved attachability.

FIGS. 10 to 14 illustrate another embodiment of the present invention. Detailed explanations of parts that are identical or similar to those in the embodiment of FIGS. 1 to 8 will be omitted, and like reference numerals will be imparted thereto. In this example, engaging openings 31 to be engaged with the anti-detach hooks 6 are provided, having a width of the openings being same as that of the cutouts 12, directly under the lower portions of the cutouts 12 between the blades 8 in the longitudinally defined center region D1. Further, the lower portions of the engaging openings 31 are positioned at the same height as that of the lower portions of the cutouts 12 between the blades 8 provided at the longitudinally defined end regions D2.

Figure 11:
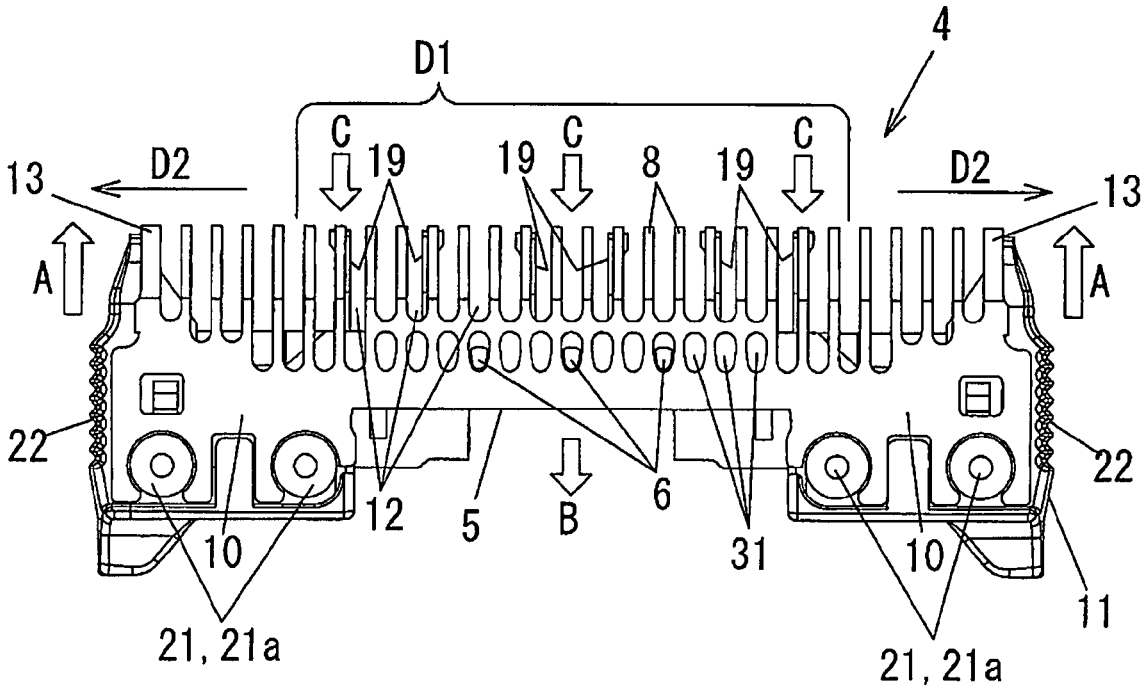
FIG. 11 illustrates a front view of the inner blade member of FIG. 10.
Figure 12A:
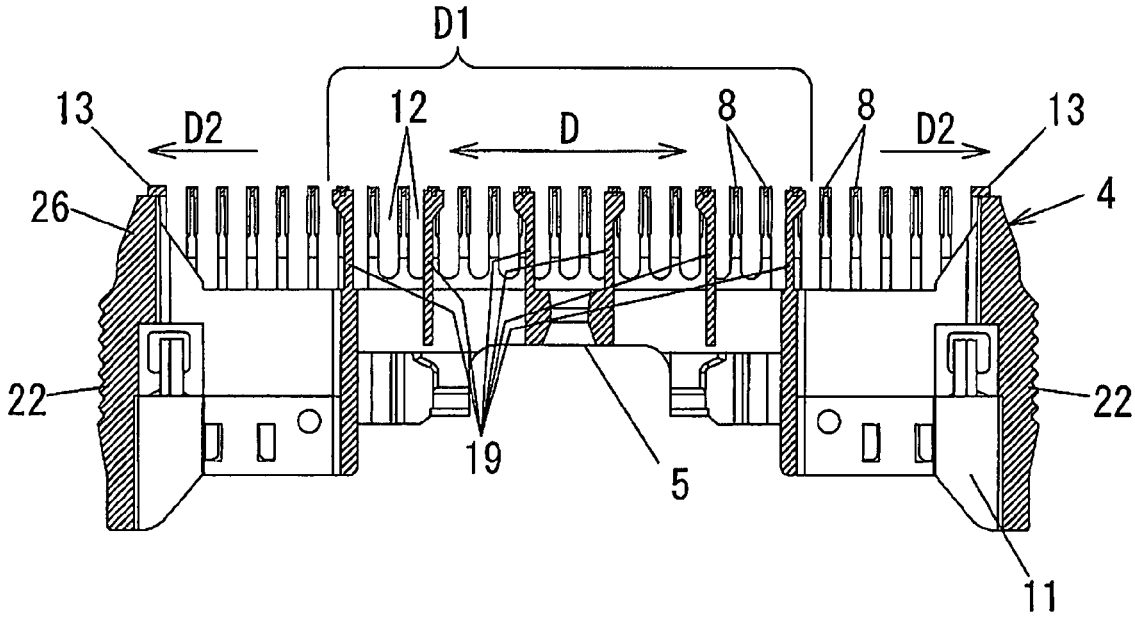
FIGS. 12A and 12B illustrate a cross sectional front view of a blade holder of the inner blade member in FIG. 10 and an enlarged view of principal parts in the blade holder in FIG. 12A, respectively.
Figure 12B:
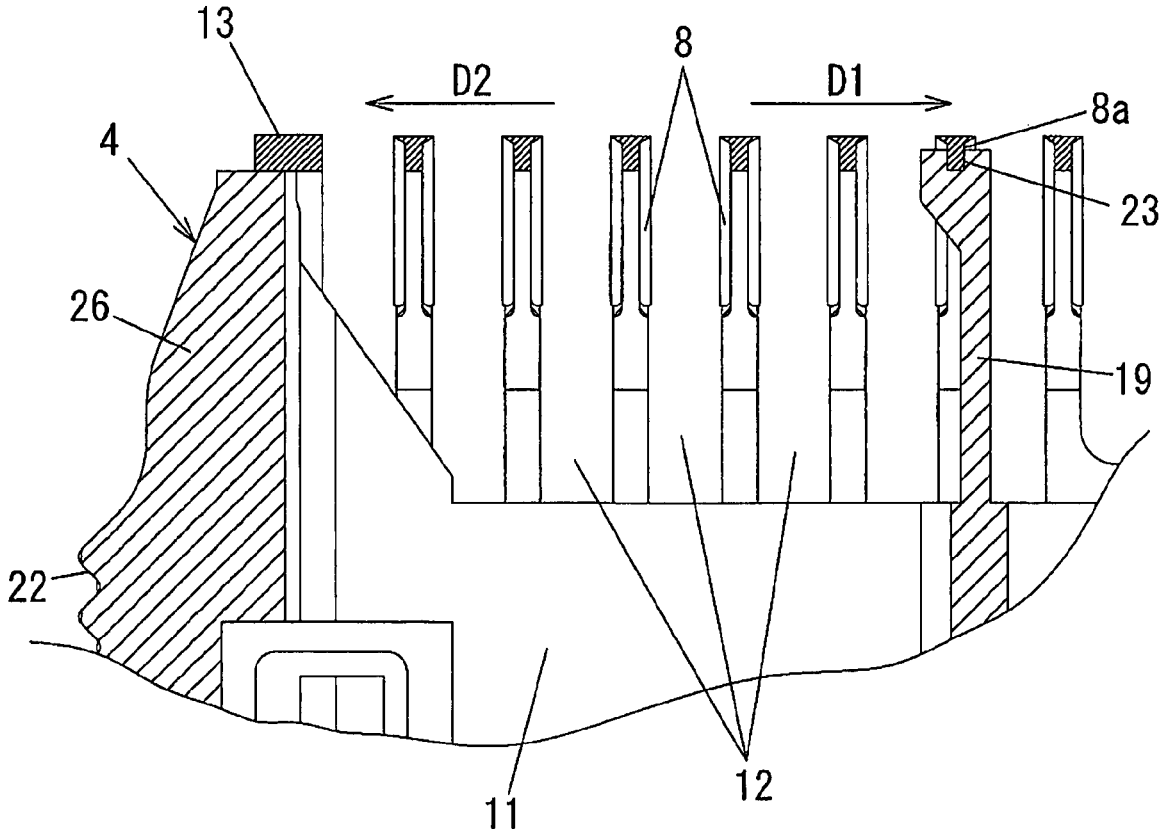
Figure 13:
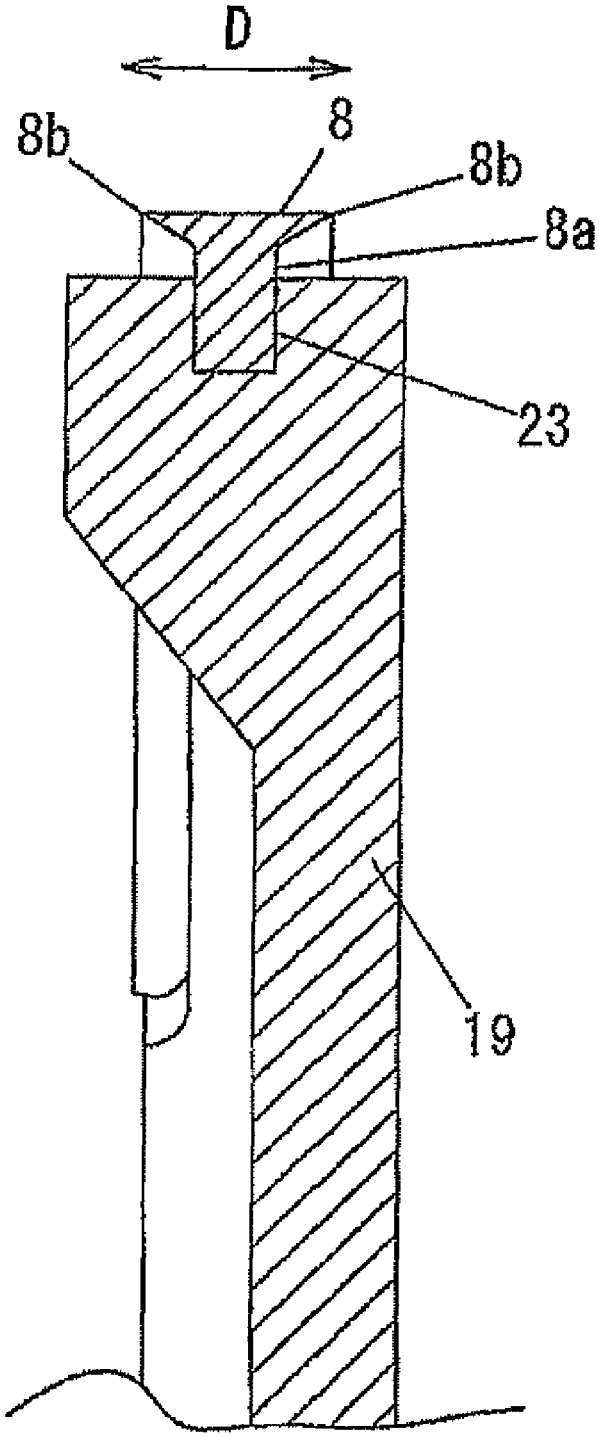
FIG. 13 illustrates a cross sectional front view to explain an example of an insertion-fitting between a plate member and blades in the inner blade member in FIG. 10.
Figure 14:
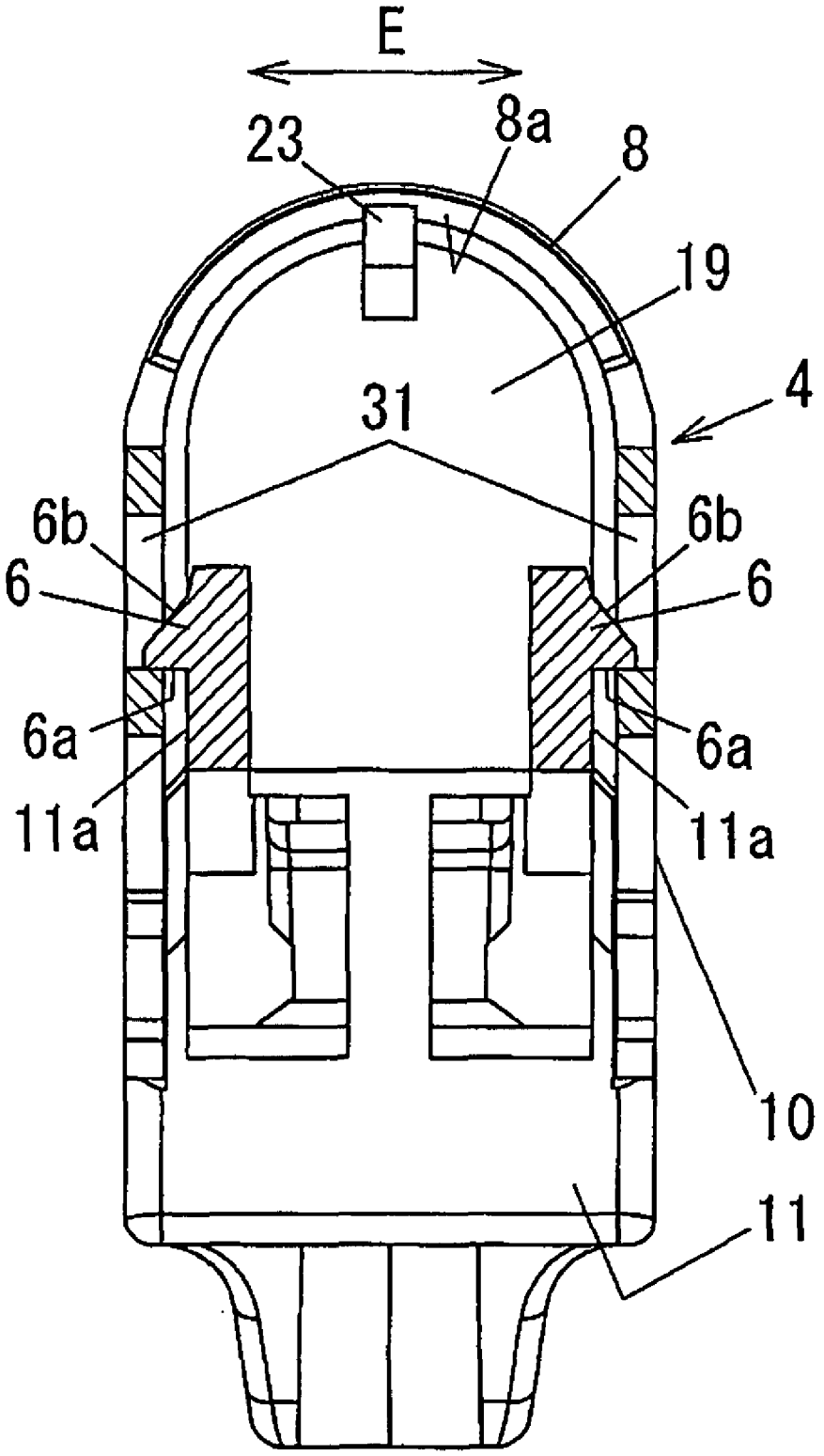
FIG. 14 illustrates a cross sectional side view to explain an engagement between a anti-detach portion and a blade plate in the inner blade member in FIG. 10.

Moreover, as shown in FIG. 11, the height of the anti-detach hooks 6 is reduced so as to be shorter than the height of the engaging openings 31, and the anti-detach hooks 6 are allowed to be engaged with the lower portions of the engaging openings 31. Since the engaging openings 31 are isolated from the cutouts 12 between the blades 8, the blade plate 10 can have less bored regions (since the space between the cutouts 12 and the engaging openings 31 does not include opening portions), thereby maximizing the structural rigidity of the blade plate 10 due to boring. In addition, the blades 8 can be more firmly supported by the plate members 19 by closely inserting the bottom surfaces of the insertion-fitting portions 23 to the lower portions of the blades 8, as can be seen from FIG. 13.

Figure 15:
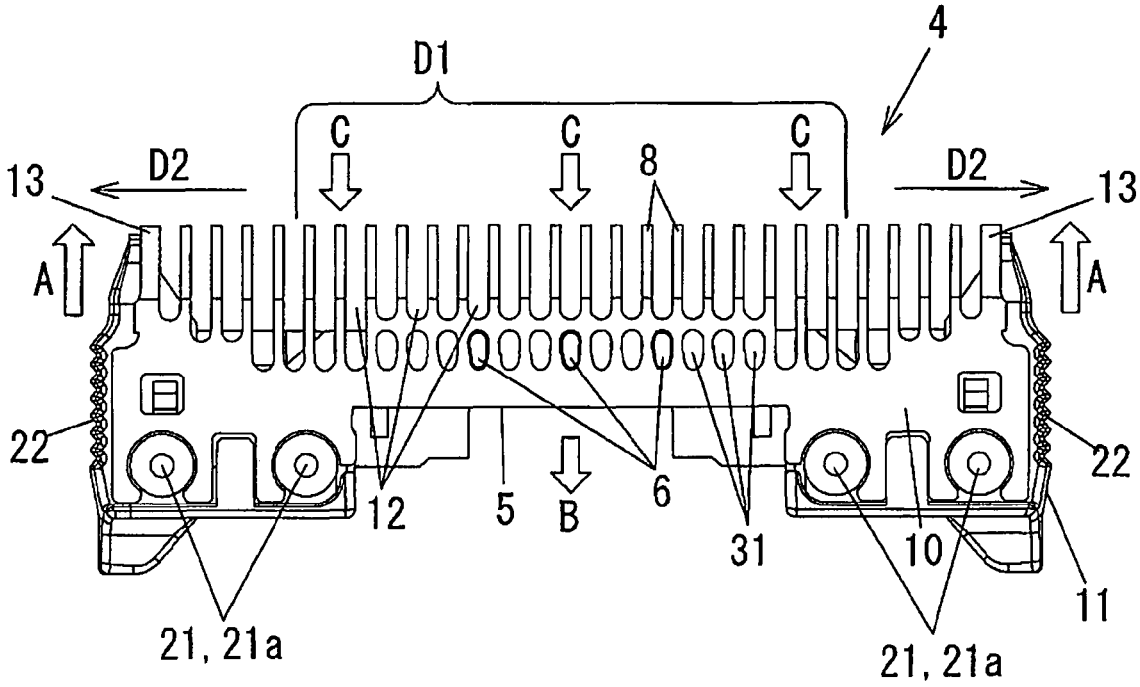
FIG. 15 illustrates a front view of an inner blade member in accordance with still another embodiment of the present invention.
Figure 16:
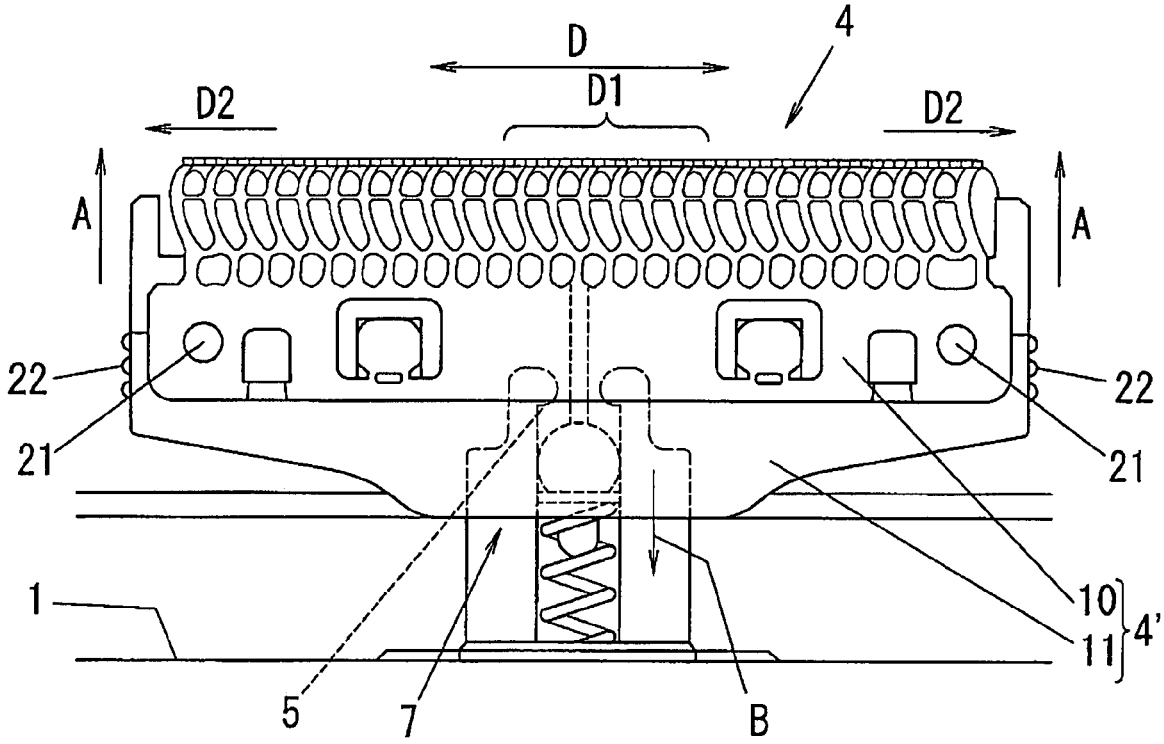
FIG. 16 (PRIOR ART)
FIG. 16 illustrates a conventional blade which can be dissembled from a driving unit.

FIG. 15 represents still another embodiment of the present invention. Detailed explanations of parts that are identical or similar to those in the embodiment of FIGS. 10 to 14 will be omitted, and like reference numerals will be imparted thereto. In this example, as depicted in FIG. 15, the size of the engaging openings 31 is substantially equal to that of the anti-detach portions 6, so that the anti-detach hooks 6 are allowed to be inserted in the engaging openings 31 with a minimum slack therebetween.

Therefore, when assembling the blade holder 11 to the driving units 7, the anti-detach hooks 6 prevent deformation of the blade plate 10 in the longitudinally defined center region D1 deforming closer to the blade holder 11 in the longitudinally defined center region D1 due to the compressive load C. Also, when detaching the blade holder 11 from the driving units 7, it prevents deformation of the blade holder 11 in the longitudinally defined center region D1 deforming closer to the blade plate 10 in the longitudinally defined center region D1 due to the tensile load B. That is, the anti-detach hooks 6 have a first anti-detach function with respect to the tensile direction and a second anti-detach function with respect to the compressive direction. Accordingly, the plate members 19 employable in the embodiments of FIGS. 1 to 14 can be absent in the present embodiment of the present invention, thereby simplifying the structure of the blade holder 11.

While the invention has been shown and described with respect to the embodiments, it will be understood by those skilled in the art that various changes and modification may be made without departing from the scope of the invention as defined in the following claims.

What is claimed is:

1. An electric shaver comprising:

net-shaped outer blades; and inner blades sliding reciprocally over an inner side of the outer blades as detachably connected with driving units driven by a motor, wherein each of the inner blades includes:

a blade plate having inversed U-shaped blades in a longitudinal direction in parallel with a reciprocating sliding direction; and a blade holder having attaching portions in longitudinally defined end regions to fix the blade holder and the blade plate as a unit, wherein connection portions to be detachably connected with the driving units are provided at the blade holder in a longitudinally defined center region, and, upon dissembling the blade holder from the driving units, anti-detach portions are provided near the connection portions to thereby prevent separation of the blade holder in the longitudinally defined center region from the blade plate in the longitudinally defined center region due to a tensile load between the connection portions and the driving units, wherein the anti-detach portions are formed as hooks to be engaged at gaps between the inversed U-shaped blades, wherein the hooks are provided above the attaching portions, wherein slit-shaped cutouts are provided between the inversed U-shaped blades, and wherein lower portions of the slit-shaped cutouts are engaged with the hooks such that the hooks are disposed above the lower portions of the slit-shaped cutouts.

2. The electric shaver of claim 1, wherein the anti-detach portions prevent, when attaching the blade holder to the driving unit, deformation of the blade plate in the longitudinally defined center region deforming closer to the blade holder in the longitudinally defined center region due to a compressive load applied to the blade plate in the longitudinally defined center region.

3. The electric shaver of claim 1, wherein the blade holder is provided with plate members for supporting upper rear surfaces of at least parts of the inversed U-shaped blades close to the blade plate in the longitudinally defined center region against the compressive load applied, when attaching the blade holder to the driving units, to the blade plate in the longitudinally defined center region.

4. The electric shaver of claim 3, wherein the plate members have at leading ends thereof insertion-fitting portions to be insertion-fitted without being detached from the upper rear surfaces of the inversed U-shaped blades.

5. The electric shaver of claim 3, wherein the anti-detach portions and the plate members are misaligned in the longitudinal direction of the blade holder.

6. The electric shaver of claim 4, wherein the anti-detach portions and the plate members are misaligned in the longitudinal direction of the blade holder.

7. The electric shaver of claim 1, wherein the hooks are formed in a longitudinally defined center region below respective plate members and insertion-fitting portions.

8. The electric shaver of claim 1, wherein the hooks are on an inner blade portion to shift the force along the longitudinal direction to prevent deformation by creating a truss structure.

* * * * *